US010449418B2

(12) United States Patent
Bitton et al.

(10) Patent No.: US 10,449,418 B2
(45) Date of Patent: Oct. 22, 2019

(54) BOUNCING DEVICE THAT IS VERTICALLY ORIENTED AND CENTRIFUGALLY BALANCED

(71) Applicant: SPIN TRICKS TOYS INC., Tenafly, NJ (US)

(72) Inventors: Oren Bitton, Matan (IL); Reuven Ozer, Tel Aviv (IL)

(73) Assignee: SPIN TRICKS TOYS INC., Tenafly, NJ (US)

( * ) Notice: Subject to any disclaimer, the term of this patent is extended or adjusted under 35 U.S.C. 154(b) by 0 days.

(21) Appl. No.: 16/095,703

(22) PCT Filed: Sep. 12, 2018

(86) PCT No.: PCT/IL2018/051024

§ 371 (c)(1),
(2) Date: Oct. 23, 2018

(87) PCT Pub. No.: WO2019/003232

PCT Pub. Date: Jan. 3, 2019

(65) Prior Publication Data

US 2019/0168073 A1 Jun. 6, 2019

Related U.S. Application Data

(60) Provisional application No. 62/557,178, filed on Sep. 12, 2017.

(51) Int. Cl.

| | |
|---|---|
| ***A63B 25/08*** | (2006.01) |
| ***A63B 23/035*** | (2006.01) |
| *A63B 21/02* | (2006.01) |
| *A63B 21/22* | (2006.01) |

(52) U.S. Cl.
CPC ..... *A63B 25/08* (2013.01); *A63B 23/03525* (2013.01); *A63B 21/023* (2013.01); *A63B 21/222* (2015.10)

(58) Field of Classification Search
CPC . A63B 25/08; A63B 23/03525; A63B 21/023; A63B 21/222
USPC ..... 446/256, 257, 258, 259, 260, 264, 268, 446/308, 312, 330
See application file for complete search history.

(56) References Cited

U.S. PATENT DOCUMENTS

| | | | | |
|---|---|---|---|---|
| 1,253,195 A * | 1/1918 | Schoell | ..... | A63H 1/02 446/260 |
| 1,974,516 A * | 9/1934 | Schmidt | ..... | A63H 1/16 446/264 |
| 2,799,120 A | 7/1957 | Pitton | | |

(Continued)

FOREIGN PATENT DOCUMENTS

| | | | | |
|---|---|---|---|---|
| CA | 2168270 | 7/1997 | | |
| GB | 173096 A * | 12/1921 | ..... | A63H 1/06 |
| KR | 200483621 | 6/2017 | | |

*Primary Examiner* — Vishu K Mendiratta
(74) *Attorney, Agent, or Firm* — Mark M. Friedman

(57) ABSTRACT

A handheld bouncing device that is vertically oriented and centrifugally balanced including: (a) an elongated, compressible axle; (b) a planar body having a balanced symmetrical shape and a central aperture, the elongated compressible axle disposed within the central aperture such that a middle section of the elongated compressible axle is rotationally coupled to the planar body, such that the elongated compressible axle protrudes from the central aperture perpendicular to a plane of the planar body.

8 Claims, 9 Drawing Sheets

(56) References Cited

U.S. PATENT DOCUMENTS

| | | | | | |
|---|---|---|---|---|---|
| 3,108,395 | A | | 10/1963 | Goldfarb | |
| 5,591,062 | A | | 1/1997 | Hettinger | |
| 5,827,107 | A | * | 10/1998 | Bears | A63H 1/20 446/263 |
| 6,390,956 | B1 | | 5/2002 | Seelye et al. | |
| 2015/0125838 | A1 | | 5/2015 | Pack | |
| 2016/0228777 | A1 | | 8/2016 | Cai | |

* cited by examiner

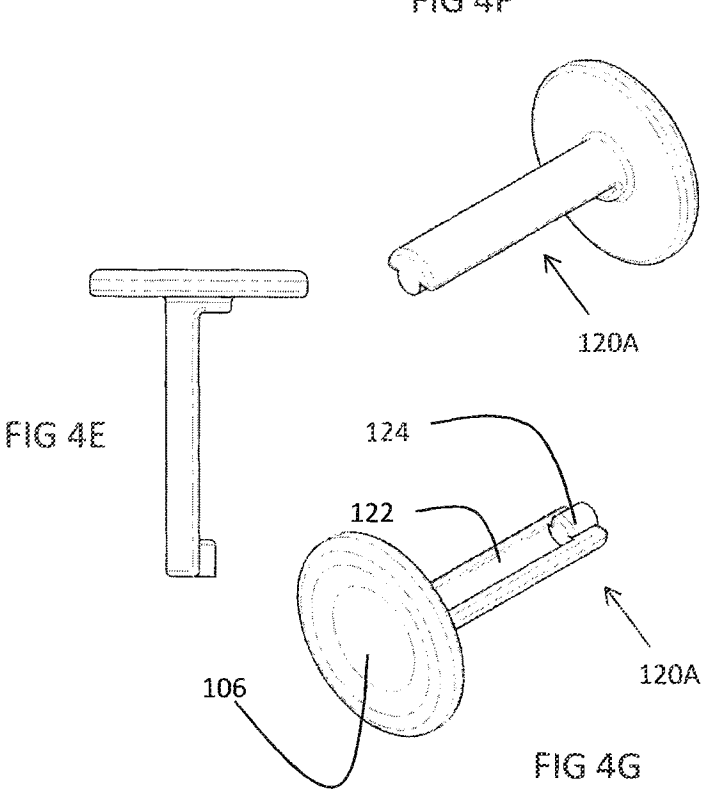
FIG 4F
FIG 4E
FIG 4G
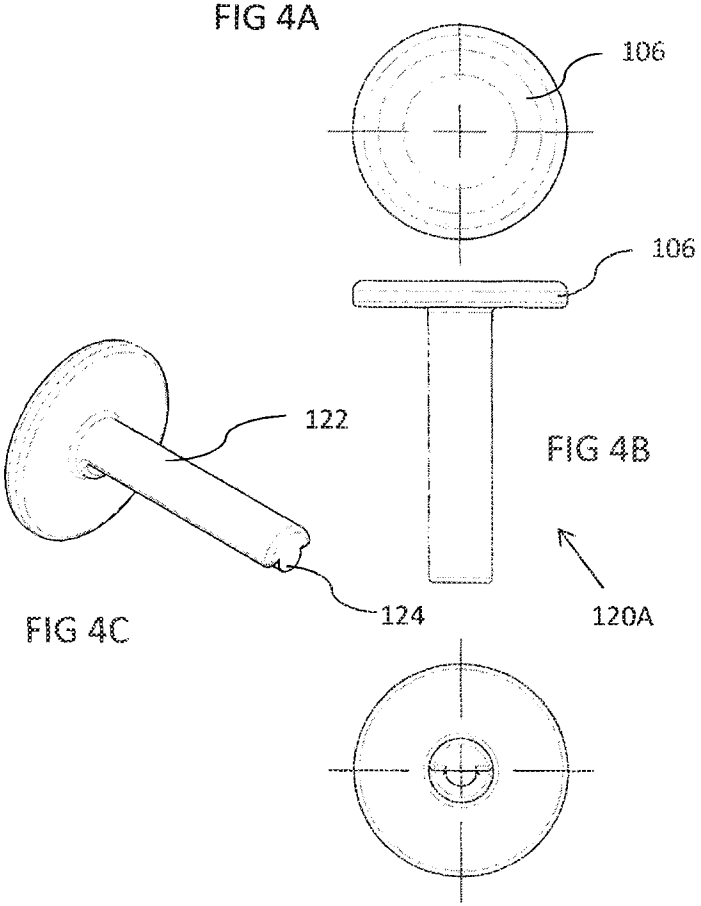
FIG 4A
FIG 4B
FIG 4C
FIG 4D

SECTION A-A

BOUNCING DEVICE THAT IS VERTICALLY ORIENTED AND CENTRIFUGALLY BALANCED

FIELD OF THE INVENTION

The present invention relates to a bouncing toy, and more particularly to a vertically oriented bouncing device that is centrifugally balanced. A compressible and spring-loaded bar is balanced by a planar body coupled to the midpoint of the bar and adapted to spin about the bar to provide centrifugal force to balance the bar in a vertical orientation.

BACKGROUND OF THE INVENTION

Vertically oriented bouncing toys, such as a pogo stick, are known in the art. However, such toys must be balanced by the user, through continuous motion, usually of the user's entire body.

SUMMARY OF THE INVENTION

The present invention discloses a handheld device that includes a compressible bar that is spring-loaded, allowing the device to bounce. The bar is maintained in a vertical orientation by centrifugal force. The centrifugal force is produced by a symmetrically formed and equally balanced planar body that is affixed to the midpoint of the bar and rotates about the axis of the bar.

According to the present invention there is provided a handheld bouncing device that is vertically oriented and centrifugally balanced including: (a) an elongated, compressible axle; (b) a planar body having a balanced symmetrical shape and a central aperture, the elongated compressible axle disposed within the central aperture such that a middle section of the elongated compressible axle is rotationally coupled to the planar body, such that the elongated compressible axle protrudes from the central aperture perpendicular to a plane of the planar body.

According to further features in preferred embodiments of the invention the compressible axle is adapted to move reciprocally along a central axis of the compressible axle.

According to still further features in the described preferred embodiments the planar body is adapted to rotate about the central axis. According to still further features the elongated compressible axle comprises: (i) a collapsible body, having an expanded state and a collapsed state, (ii) a biasing member, biasing the collapsible body in the extended state, and (iii) a pad disposed at each end of the collapsible body.

According to still further features the elongated compressible axle comprises: (i) a first member and a second member, each member including an elongated semi-circular section, a pad on a first end of the elongated section and a protrusion on a second end of the elongated section; the first and second members arranged in an interlocking fashion such that the protrusion of the first member is slidably disposed inside a hollow side of the elongated semi-circular section and vice versa; (ii) a biasing member, biasing the first and second members away from each other.

According to still further features the biasing member is disposed outside the elongated semi-circular sections, and held in place by the pads. According to still further features the biasing member is a compression spring having a spaced apart coil section, an abutting coil section and another spaced-apart coil section. According to still further features the spaced apart coil sections have a wider diameter than the abutting coil section. According to still further features the abutting coil section is disposed within the central aperture.

BRIEF DESCRIPTION OF THE DRAWINGS

Various embodiments are herein described, by way of example only, with reference to the accompanying drawings, wherein:

FIG. 4A-G are various views of the interlocked bar elements that move along the central axis;

DESCRIPTION OF THE PREFERRED EMBODIMENTS

The principles and operation of a spindle spinner according to the present invention may be better understood with reference to the drawings and the accompanying description.

Figure 1A:
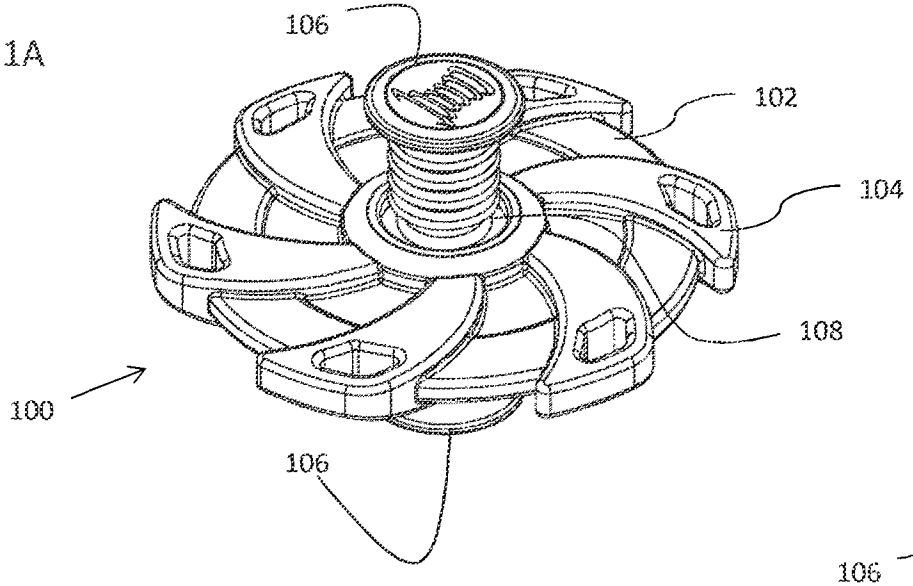
FIG. 1A is a isometric top view of an exemplary embodiment of the vertically orientated bouncing device that is centrifugally balanced.
Figure 1B:
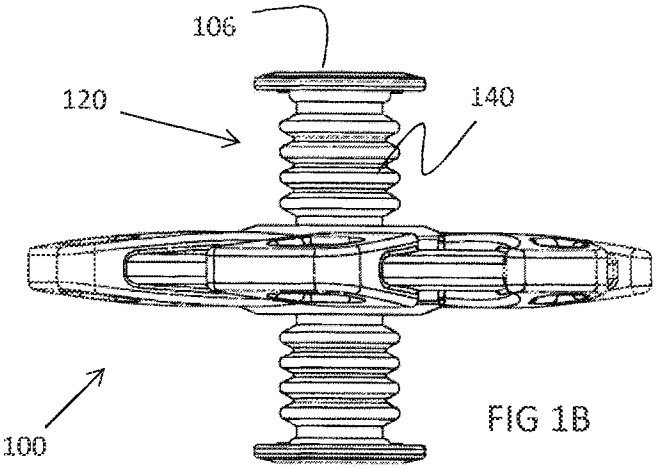
FIG. 1B is a side view of the innovative bouncing device.
Figure 2:
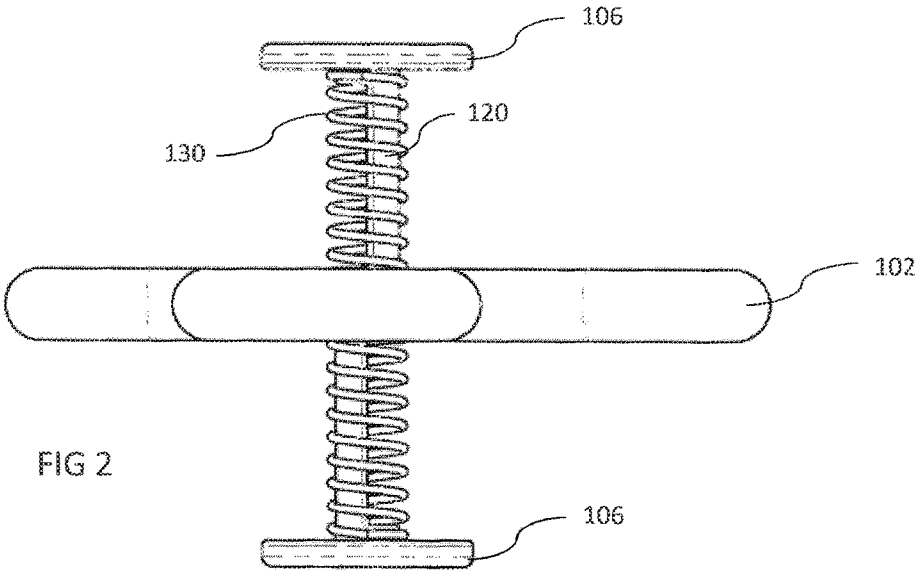
FIG. 2 is a side view of the bouncing device with the sleeve removed and the spring visible.
Figure 3:
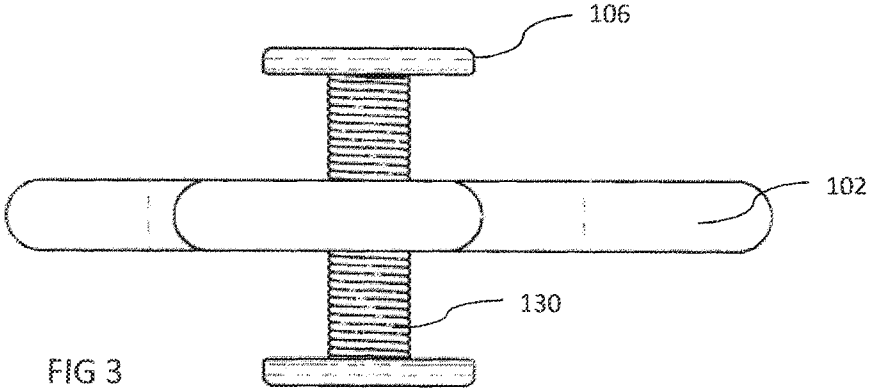
FIG. 3 is a side view of the bouncing device, in a compressed state.

Referring now to the drawings, FIG. 1A illustrates an isometric top view of an exemplary embodiment of the vertically orientated bouncing device that is centrifugally balanced. FIG. 1B is a side view of the handheld bouncing device. FIG. 2 is a side view of the bouncing device with the sleeve removed and the spring visible. In FIGS. 1A, 1B and 2, the innovative bouncing device is in an expanded state. FIG. 3 is a side view of the bouncing device, in a compressed state.

Referring to all of the aforementioned figures, the innovative vertically oriented bouncing device 100 comprises a springy compressible bar or spindle 120 that is spring-loaded and each end of the bar/spindle/axle terminates in a finger pad 106. The pads are flat and have a diameter that is larger than the diameter of the bar. By itself, the central bar is able to stand on one of the pads, vertically oriented. However, in order to play the device and do various manipulations, the bar need to be held upright. This is achieved using centrifugal force.

Figure 5B:
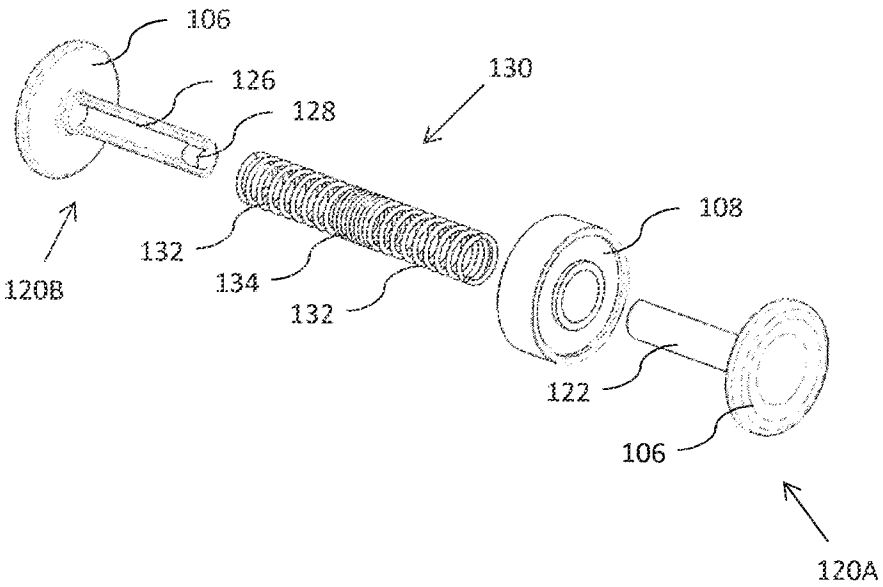
FIG. 5B is an exploded view of the compressible axle, bearing and spring.
Figure 5A:
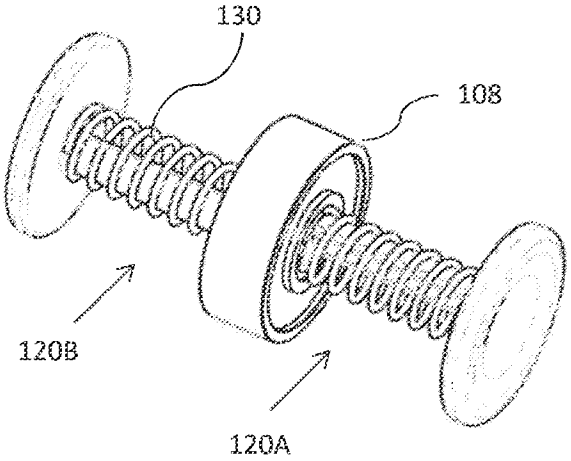
FIG. 5A is an isometric view of the compressible axle, bearing and spring.

A centrifuge member consists of a frame 102, balancing weights 104 (affixed to the frame or integrated into the frame) and a bearing 108 (best seen in FIG. 5A). The compressible, spring-loaded bar 120 passes through an opening at the center of the bearing. The inner race of the bearing abuts the spring-loaded bar 120 and the outer race of the bearing abuts the frame.

The frame defines a circular disk when spinning, regardless of the precise structure of the frame. The frame consists of a planar body radiating from a central aperture in a balanced form (e.g. equidistantly spaced lobes or a symmetrically shaped body such as a disk, square or triangular-shaped body etc.). The frame can be made of various types of metal and/or plastic material or wood. The middle bearing allows the frame to rotate and spin faster and for longer than a spinning top by reducing the friction between body and the bouncing bar. The weights are attached or built into the peripheral ends of the prongs, spokes, wings ("lobes") or symmetrically shaped body of the centrifuge member 120. Depending on the design of the body, there may be two or more individual lobes or a completely contiguous shape e.g. a wheel shape design. The weights on the outer edges of the prongs or periphery of the frame balance the centrifuge member and allow it to spin better. The bar 120 adds a vertical dimension to the otherwise flat or planar centrifuge member.

The frame 102, taken alone, is a substantially horizontally planar member, having a substantially flat profile. The terms vertical and horizontal, as applied to the instant device, are essentially misnomers. This is due to the fact that horizontal and vertical are fixed orientations whereas the present device is handheld and can be oriented in various different orientations. As such, a more precise definition is offered whereby the frame of the device rotates about a central axis (as known in the art) on a given plane and innovatively includes the central member compressible bar that bisects the given plane such that the axis of the central member is perpendicular to the plane of rotation. The central bar/axle increases the geometric features of the centrifuge member by increasing the profile thereof many fold, such as, for example, by 6 or 8 times. The innovative device can spin like a spinning top, and because of the centrifugal force, the bouncing device will, in most cases, land up standing vertical on one of the pads. The compressible bar bounces, increasing the number and types of manipulations exponentially. A myriad of additional manipulations can be made with the improved mechanism.

In preferred embodiments, the central member is a compressible axle. In one exemplary configuration, the central axle 120 is made up of two separate but interlocking members. Each member has an elongated section which terminates on one end in a finger pad 106. In one embodiment, the elongated sections of the interlocking members of the central axle are innovatively encircled by a spring 130, which is held in place by the wider finger pads on either end of the axle. The spring also holds the interlocking members together. In preferred embodiments, the spring is covered with a sleeve or sleeves 140.

In another embodiment (not shown), the spring is disposed inside the central axle, biasing movable members away from the center of the frame in opposing directions perpendicular to the plane of rotation. In the same embodiment, or the former embodiment, the axle may consist of a collapsible body having an expanded state and a collapsed state. The axle may further consist of a biasing member that biases the collapsible body in the extended/expanded state. The axle may extend telescopically, e.g. telescoping out from the central aperture, in both directions, by extending nestled segments of the compressible/collapsible axle.

According to all embodiments, the biasing member may be a compression spring. The biasing member may be composed of any material with the elastic ability to resist a distorting influence and to return to its original size and shape when that influence or force is removed.

In all embodiments, each end of the elongated compressible axle is adorned with a pad. The axle (which includes the pads) has the shape of a fixed weight dumbbell, i.e. a thinner tube in the middle with wider, flat circular pads on the ends.

In all embodiments of the compressible axle, the axle is compressed under pressure. For example, the user can squeeze his or her thumb and forefinger (each of which is placed on one of the pads) together, compressing the axle. When pressure is lessened, the biasing member pushes the axle back into the expanded state. The device can also be bounced on various surfaces and body parts. The biasing member makes the axle springy, not merely compressible. Users can spin the planar body and then balance, bounce, "pop" or otherwise manipulate the device, taking advantage of the springy and bouncy axle. The device can be bounced on the floor, bounced from knee to knee, bounced or "popped" off a shoulder, bounced from hand to hand and many other manipulations.

In both of the embodiments including compressible axles (one embodiment with an external spring and one embodiment with an internal spring), the device is adapted to rotate about a central axis and to move in reciprocal directions along the same central axis. For the user, the spring spinner offers an additional mode of interaction with the device. The user can spin the frame, and in addition, the user can squeeze the compressible axle. The compressible axle 120 of the bouncing device 100 is held in a pincer grip with one finger on each pad 106, so that the user can compress and release the spring 130 in addition to spinning the frame 102 with another finger on the same hand or other hand.

FIGS. 4A to 40 depict various views of one of the members of the axle 120. As described above, the compressible axle 120 is made up of two elongated pieces 120A, 120B that fit together (interlock). The first elongated piece 120A is depicted in FIGS. 4A-4G. The first member 120A is made up of a semi-circular, hollow, elongated section 122 with a pad 106 on one end and a protrusion or knob 124 at the other end.

The second elongated piece 102B is a mirror image of the first piece. The elongated, semi-circular, hollow section of member 120B is referenced as section 126 and the protrusion or knob is references as protrusion 128. When assembled together, the protrusion 124 of the first member 120A slides along the hollow section 126 of the second member 120B, and vice versa.

For the sake of clarity, the pad end of each elongated piece 120A, 120B is referred to as the top, while the knob end is referred to as the bottom. The concave face (hollow side) of the piece is referred to as the front. The convex face of the elongated piece is referred to as the back. As such, FIG. 4A is a top view of elongated piece 120A. FIG. 4B is a side view of the back of elongated piece 120A. FIG. 4C is an isometric top view of the back of the elongated piece 120A. FIG. 4D is a bottom view of the elongated piece 120A. FIG. 4E is a profile view of elongated piece 120A. FIG. 4F is a top isometric view of the back of the elongated piece 120A. FIG. 4G is a top isometric view of the front of the elongated piece 120A.

FIG. 5A is a view of the central axle 120, bearing 108 and spring 130. FIG. 5B is an exploded view of the components in FIG. 5A. In the depicted embodiment, there is a single spring 130 that has coils that are spaced apart on either end 132 and closely wound (e.g. coils are touching or very slightly spaced apart) in the middle section 134. Exemplarily, bearing 108 consists of a larger ring and a smaller ring. Sandwiched between the rings are a number of ball-bearings. The ball-bearings lie within a groove, known as the racer, and are held at regular intervals around the ring by a separator, also referred to as a "cage". The outer and inner rings, plus ball-bearings themselves are made from metal and/or any combination of a handful of ceramic compositions, as is known in the art. The closely wound, middle section of the spring is in frictional contact with the inner ring of the bearing.

Figure 6A:
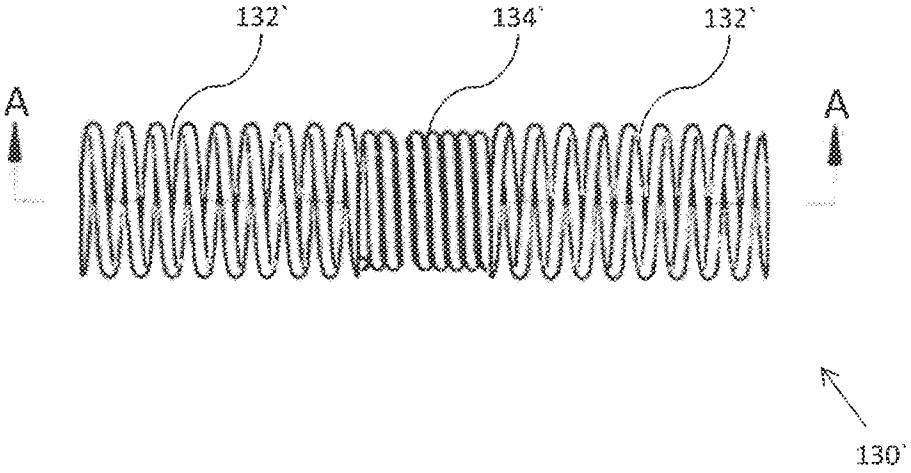
FIG. 6A is a side view of a second embodiment of the spring.
Figure 6B:
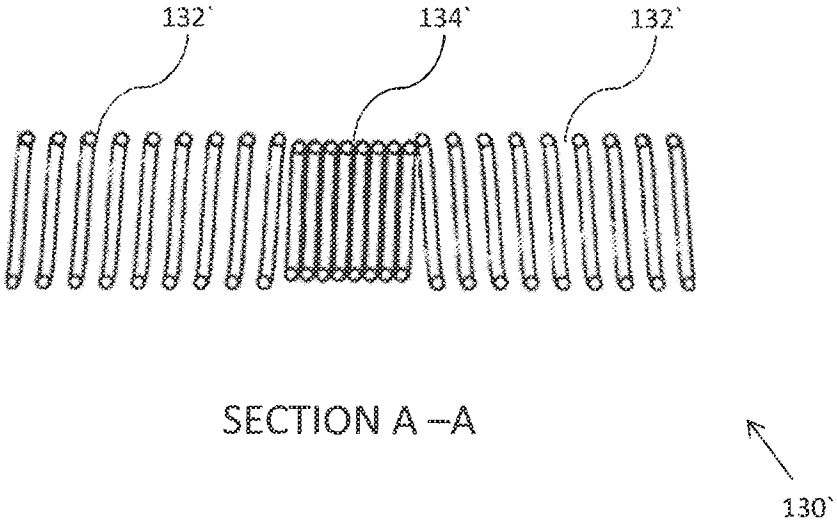
FIG. 6B is a cross-sectional view of FIG. 6A.

Another embodiment of the spring component is shown in FIGS. 6A and 6B. FIG. 6A depicts a second embodiment of the spring, referenced as spring 130'. Spring 103' is a single spring with different diameters at different sections of the spring. The elongated spring has a wider diameter on the ends 132'. In the middle section 134', the diameter of the spring 130' is smaller than the diameter of sections 132'. For example, and in no way being limiting, the wider sections 132' can be 9 millimeters in diameter and the middle section 134' can be 8 mm in diameter. In addition, in the central section 134' of the spring, the coils either touch each other or are minimally spaced apart. Either way, the coils are closer together in the middle section 134' than at the outer sections 132'. The coils with the wider diameter cushion the bearing on each side and the coils with the smaller diameter fit in the opening of the bearing, and are in frictional contact with the inner surface of the inner ring of the bearing.

In another embodiment, the compression spring also has three sections, spaced apart, abutting coils and then spaced apart coils again. The bearing goes over the section where the coils are abutting (this is true for all the embodiments). However, here, the entire coil is of a single diameter, except for a single coil between the spaced apart coils and the abutting coils on one side and a single coil on the other side. These single coils are slightly larger in diameter and hold the bearing in place. I.e. the bearing is held in place by the larger coils on either side thereof. In one non-limiting example, the entire spring has a coil diameter of 8 mm except for the two coils which are 9 mm in diameter each.

In other embodiments (not shown), there may be two separate springs, where each spring is compressed between the pad of one of members 120A, 120B and the bearing 108. In such an embodiment, the axle members are in frictional contact with the inner surface of the inner ring of the bearing.

Figure 7B:
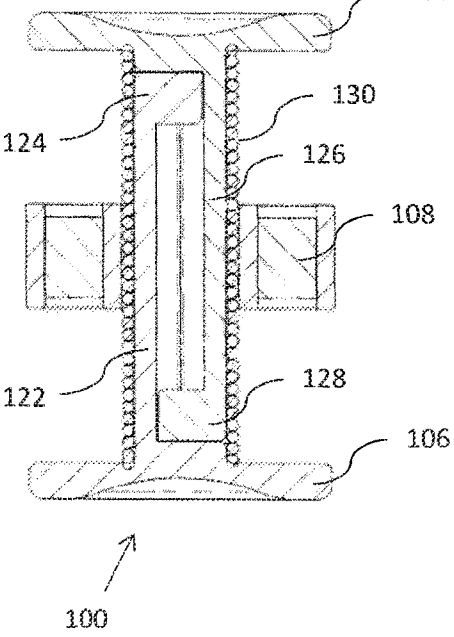
FIG. 7B is a cross-sectional view of the central mechanism in a compressed state.
Figure 7A:
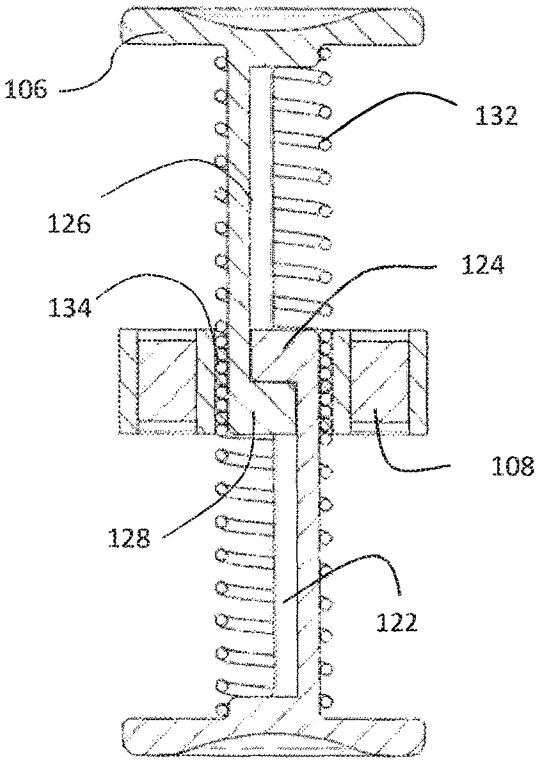
FIG. 7A is a cross-sectional view of the central mechanism in a relaxed state.
Figure 7:
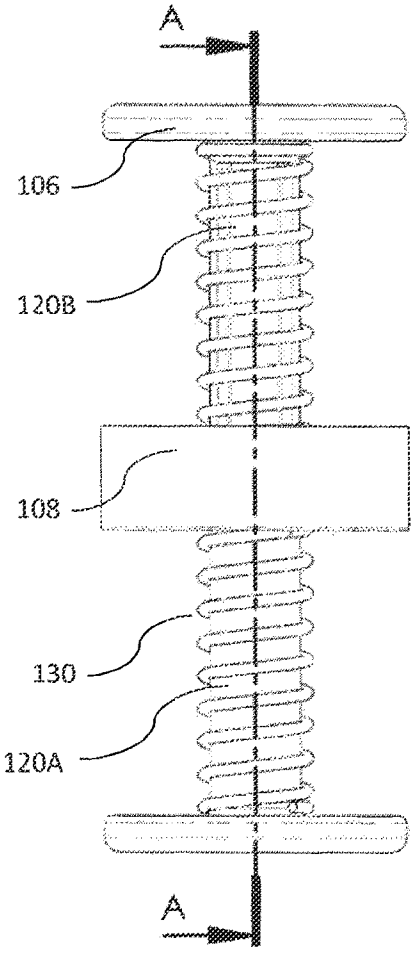
FIG. 7 is a front view of the central mechanism.

FIG. 7 is a side view of the externally spring-loaded compression mechanism. FIG. 7A is a cross-sectional view of the section A-A of FIG. 7. FIG. 7B is a cross-sectional view of a spring spinner 100 in a compressed state. When the spring is on the outside of the axle, the reciprocal, compression-expansion, movement of the axle members is hindered by frictional contact with the inner ring of the bearing. As such, the compression/expansion movements are smooth and unencumbered.

In embodiments, the actions of compressing and/or releasing the spring-loaded central axle 120 causes the frame 102 to rotate on its central axis. The more times the spring is compressed the faster the spinner spins. Those skilled in the art, based on the disclosed description, would be able to modify the instantly disclosed device to provide the described function. For example, the inner face of the smaller ring of the bearing can be ridged or a ridged member may be placed abutting the inner ring. Correspondingly, the compressible axle can be scored with a spiral or helix design on the outside/back of the elongated members of the compressible axle. The reciprocal motion along the central axis causes the frame to rotates. According to the disclosed modification, the compression spring would be inside the compressible axle, not outside. Many alternative or additional variations or modifications would be clear to one skilled in the art.

According to embodiments, the spring spinner 100 can be modified to produce a small current when the spring is compressed repeatedly. One exemplary implementation of the electrified embodiment is described as follows: Two springs sit (connected) on either side of a magnetized bearing that will spin when the springs are engaged by compressing the central axle on both sides of the bearing simultaneously.

As the springs continue to be pressed it causes the magnetized bearing to generate a small charge due to the rotation of the balls of the bearing along the vertical axis (Y-axis) with the movement of the central axle.

The charge/energy is collected and stored in a connected energy storage unit. As such, repeatedly pressing and releasing the spring-loaded pads effectively "charges" a device or rechargeable battery for later use.

In an alternative embodiment, rotation of the magnetized bearing about the central axis/bar causes the generation of electricity. In some embodiments the central bar is additionally or alternatively magnetized. In some embodiments, both actions—the spinning of the bearing about the central axis and the compressing and releasing of the spring-loaded central bar—cause the generation of electricity. As mentioned above, the energy is stored in a dedicated energy storage unit.

The aforementioned mechanism, whether embodied in a bouncing device or as a standalone mechanism or in other forms or frames, is perfect for 3rd world countries and remote locations, where electricity is unavailable or intermittently available. The device (magnetized bearing that spins when rotated and/or the springs on either side are compressed and released) is something that everyone should have in case of emergencies, such as when the power is out or an outlet is unavailable. Exemplarily, the device can be used as (or to charge) a portable cell phone charger.

Figure 8:
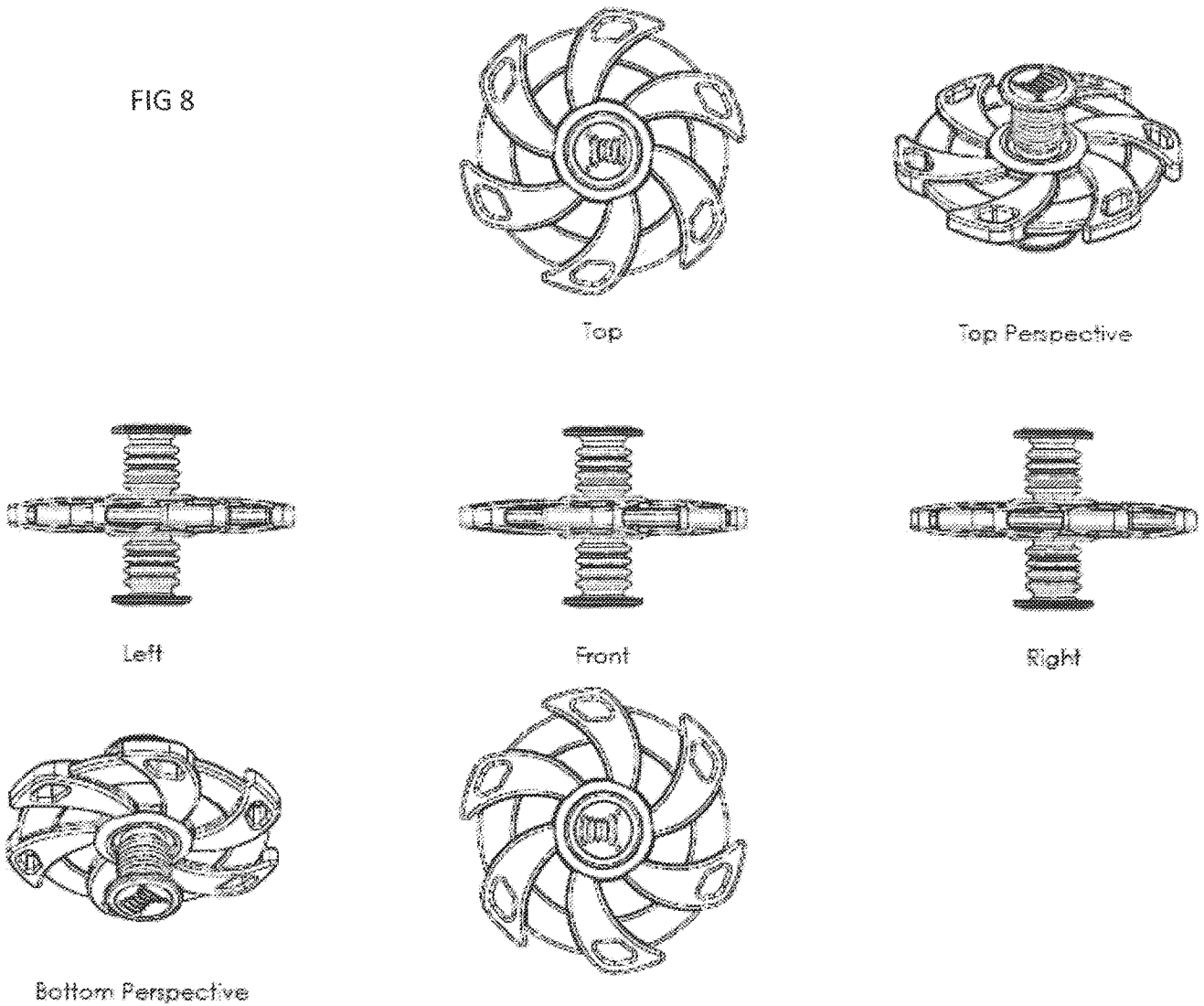
FIG. 8 depicts various views of an exemplary design of the spring spinner.
Figure 9:
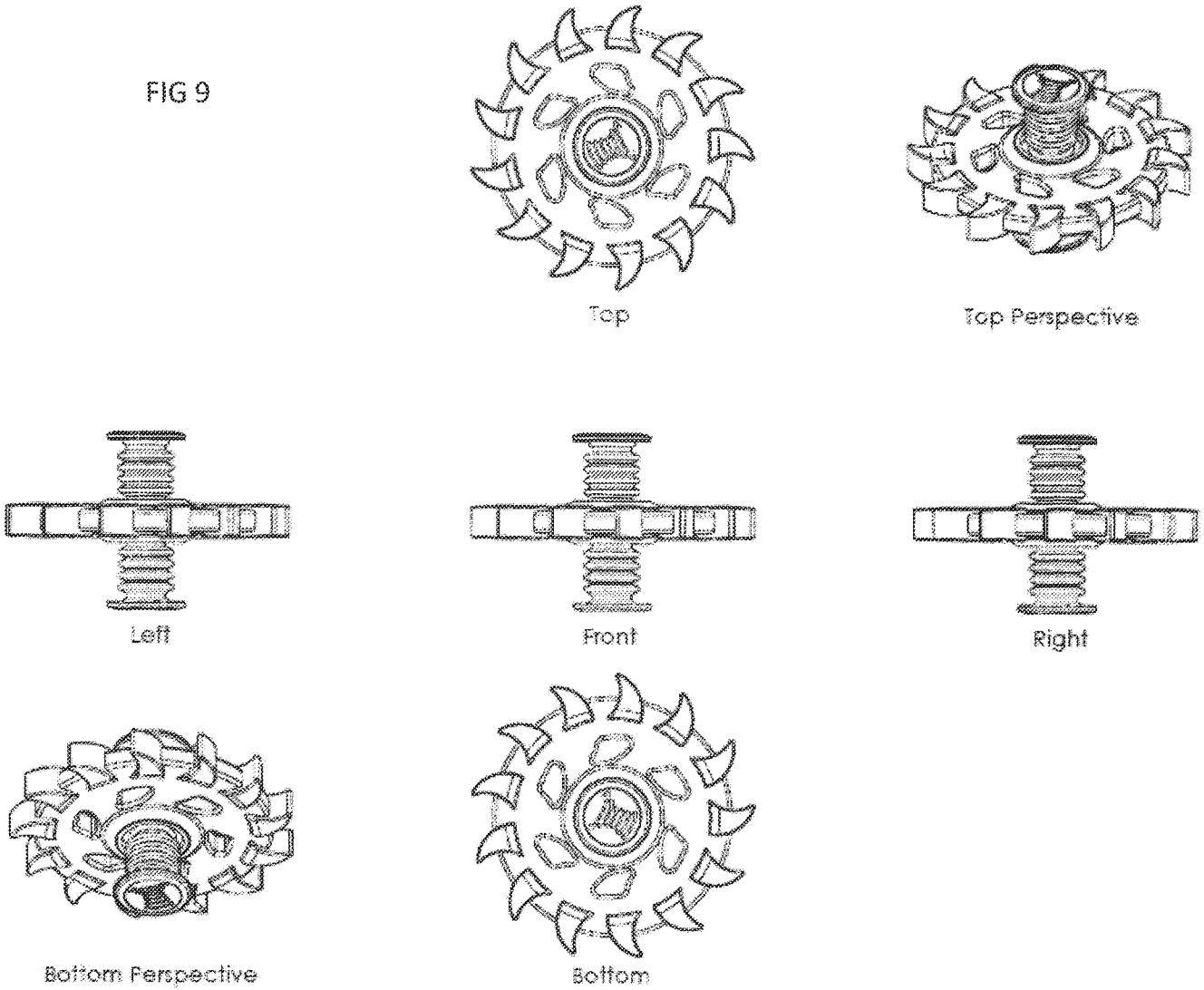
FIG. 9 depicts various views of another exemplary design of the spring spinner.
Figure 10:
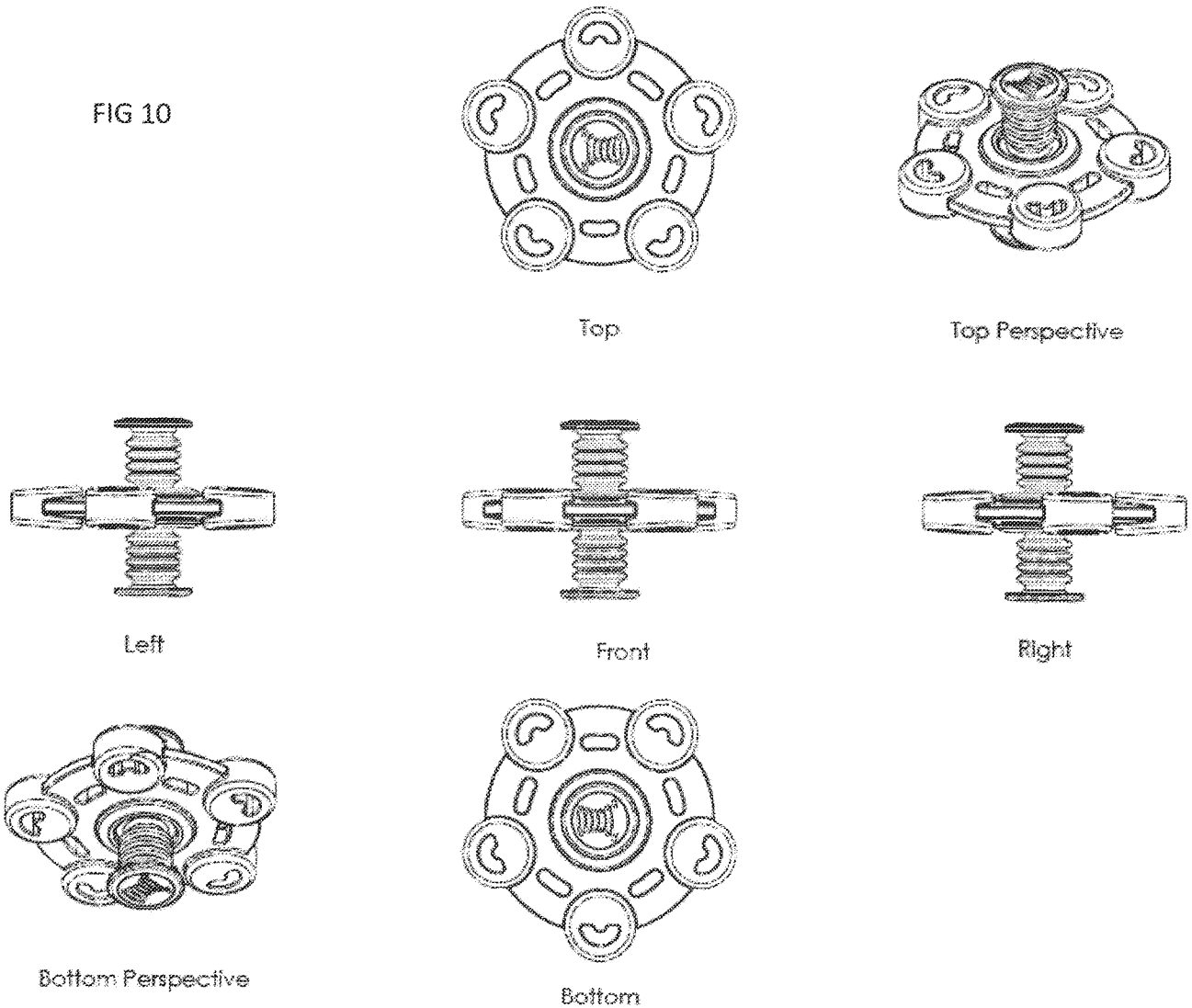
FIG. 10 depicts various views of another exemplary design of the spring spinner.

FIG. 8 depicts various views of an exemplary design of the spring spinner. In the depicted embodiment, the frame is a circular disk with raised spirals embodied on the disk. The spirals extend over the edge of the disk. FIG. 9 depicts various views of another exemplary design of the spring spinner. Here the disk frame is decorated around the peripheral edge with shark tooth-shaped blades. FIG. 10 depicts various views of yet another exemplary design of the spring spinner. Here the disk is periodically studded with circular ornaments. The spirals, blades and ornaments may or may not be weighted in order to provide balance and added inertia to the centrifuge member of the bouncing device.

It is made clear that any modification, variation or configuration mentioned heretofore for one embodiment is equally applicable to all other embodiments, mutatis mutandis.

While the invention has been described with respect to a limited number of embodiments, it will be appreciated that many variations, modifications and other applications of the invention may be made. Therefore, the invention is not limited to the embodiments described herein.

What is claimed is:

1. A handheld bouncing device that is vertically oriented and centrifugally balanced comprising:

(a) an elongated, compressible axle;

(b) a planar body having a balanced symmetrical shape and a central aperture, said elongated compressible axle disposed within said central aperture such that a middle section of said elongated compressible axle is rotationally coupled to said planar body, such that said elongated compressible axle protrudes from said central aperture perpendicular to a plane of said planar body;

wherein said elongated compressible axle comprises:

(i) a first member and a second member, each member including an elongated semi-circular section, a pad on a first end of said elongated section and a protrusion on a second end of said elongated section; said first and second members arranged in an interlocking fashion such that said protrusion of said first member is slidably disposed inside a hollow side of said elongated semi-circular section and vice versa;

(ii) a biasing member, biasing said first and second members away from each other.

2. The device of claim 1, wherein said compressible axle is adapted to move reciprocally along a central axis of said compressible axle.

3. The device of claim 2, wherein said planar body is adapted to rotate about said central axis.

4. The device of claim 1, wherein said elongated compressible axle comprises:

(i) a collapsible body, having an expanded state and a collapsed state, (ii) a biasing member, biasing said collapsible body in said extended state, and (iii) a pad disposed at each end of said collapsible body.

5. The device of claim 1, wherein said biasing member is disposed outside said elongated semi-circular sections, and held in place by said pads.

6. The device of claim 5, wherein said biasing member is a compression spring having a spaced apart coil section, an abutting coil section and another spaced-apart coil section.

7. The device of claim 6, wherein said spaced apart coil sections have a wider diameter than said abutting coil section.

8. The device of claim 7, wherein said abutting coil section is disposed within said central aperture.

* * * * *